United States Patent [19]

Moody

[11] Patent Number: 5,016,555

[45] Date of Patent: May 21, 1991

[54] SUBMARINE TORPEDO TUBE PRIMARY SEAL INTERLOCK

[75] Inventor: Paul E. Moody, Barrington, R.I.

[73] Assignee: The United States of America as represented by the Secretary of the Navy, Washington, D.C.

[21] Appl. No.: 565,784

[22] Filed: Aug. 13, 1990

[51] Int. Cl.[5] ..... B63G 8/00

[52] U.S. Cl. ..... 114/238; 114/316

[58] Field of Search ..... 114/201 R, 238, 239, 114/312, 316, 320, 335; 277/53, 58, 102; 49/303, 381, 475; 89/1.3, 5, 14.05, 1.809, 1.81, 1.816

[56] References Cited

U.S. PATENT DOCUMENTS

| | | | |
|---|---|---|---|
| 2,926,012 | 2/1960 | Maher | 114/335 |
| 3,032,835 | 5/1962 | Saar et al. | 114/335 |
| 3,386,685 | 6/1968 | Judd | 114/335 |
| 3,395,669 | 8/1968 | Keenan | 114/238 |
| 3,613,640 | 10/1971 | Cohen | 114/238 |
| 3,643,615 | 2/1972 | Cohen | 114/335 |
| 4,700,653 | 10/1987 | Harris et al. | 114/238 |

*Primary Examiner*—Sherman D. Basinger
*Assistant Examiner*—Stephen P. Avila
*Attorney, Agent, or Firm*—Michael J. McGowan; Prithvi C. Lall

[57] ABSTRACT

A mechanical interlock system is disclosed having an interlock segment that is mechanically coupled to the breech door, to the slide valve, and to the muzzle door of an associated torpedo tube in such a way that the interlock segment positively prevents opening, or the initiation of the opening sequence, of the breech door if either the corresponding muzzle door or slide valve for a particular torpedo tube is open, and that positively prevents opening, or the initiation of the opening sequences for, either the corresponding slide valve or muzzle door of a particular torpedo tube, if and as soon as the breech door is free to open, is opened or if its opening sequence is once initiated. The interlock segment and mechanical coupling of the interlock system of the present invention exhibits improved breech door stress performance and reduced manufacturing, inventory, repair and other costs.

7 Claims, 3 Drawing Sheets

SUBMARINE TORPEDO TUBE PRIMARY SEAL INTERLOCK

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a mechanical interlock assembly, and more particularly, to a torpedo tube breech door locking and breech door/muzzle door and slide valve mechanical interlock system.

(2) Description of the Prior Art

There are two primary breech door and breech door/muzzle door and slide valve interlock systems which presently exist. The "Mk 65" mechanical interlock system requires the breech door to be hinged approximately 90° to match the centerline of the tube, to be moved axially to approach the tubes breech face, and then to be rotated to thread lugs on the door into lugs which are machined into the tube barrel. As a result of these three motions, the breech door/muzzle door interlock system is quite complex and requires a large number of moving parts, including multiple gears, shafts, racks, supports, etc. The "Mk 63" mechanical interlock system requires the breech door to be hinged approximately 90° to match the centerline of the tube and to be secured to the tubes breech face by the rotation of a locking ring which is threaded onto the outside diameter of the tube. The "Mk 63" mechanical interlock system suffers from the disutility of being complex, due to the location of components on the tube, and due to the fact that some models of the "Mk 63" system have incorporated additional slide valve actuators which must also be mechanically interlocked with the system. In addition, the locking ring is large and highly stressed due to the necessity for it to span from the outside diameter of the barrel to the location where its lugs can capture the breech door lugs.

SUMMARY OF THE INVENTION

In accordance with the principal object of the present invention, a mechanical interlock system is disclosed having an interlock segment that is so mechanically coupled to the breech door, to the slide valve and to the muzzle door of an associated torpedo tube that the inventive interlock segment positively prevents opening, or the initiation of the opening sequence, of the breech door if either the corresponding muzzle door, or slide valve for a particular torpedo tube is open, and that positively prevents opening, or the initiation of the opening sequences for, either the corresponding slide valve or muzzle door, if and as soon as the breech door is free to open, is open, or if its opening sequence is once initiated. The interlock segment and mechanical coupling of the interlock system of the present invention both provides reduced complexity over the heretofore known systems, thereby resulting in reduced manufacturing, inventory, and repair and other costs, and provides an improvement in breech door system stress performance over the heretofore known systems.

BRIEF DESCRIPTION OF THE DRAWINGS

These and other objects, features and advantages of the present invention will become apparent as the invention becomes better understood by referring to the following detailed description of the preferred embodiment thereof, and to the drawings, wherein.

DETAILED DESCRIPTION OF THE PREFERRED EMBODIMENT

Figure 1:
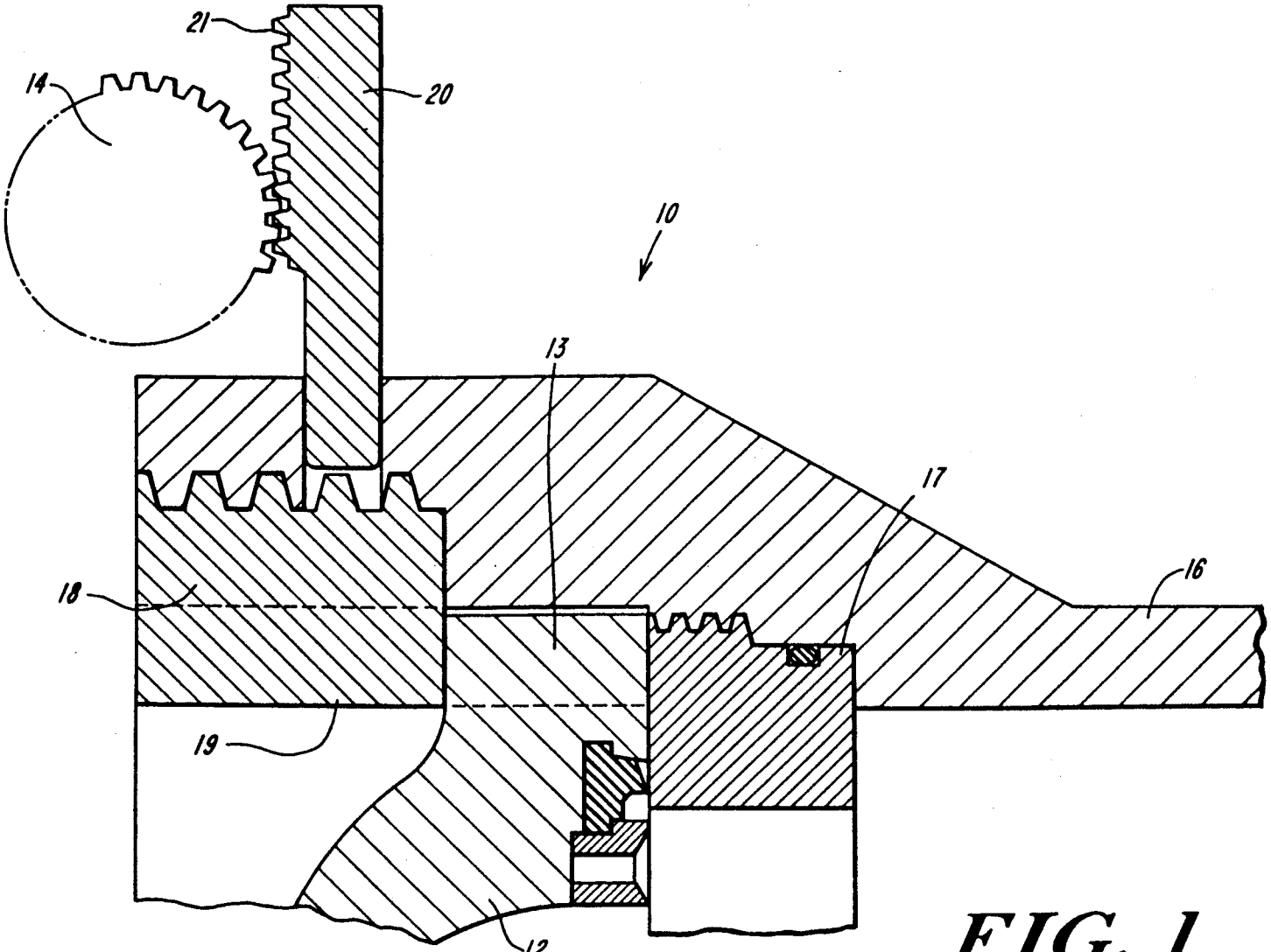
FIG. 1 is a partial sectional view of the breech end of a torpedo tube having the novel breech door locking and breech door/muzzle door and slide valve mechanical interlock system of the present invention.

Referring now to FIG. 1, generally designated at 10 is a partially sectional view of a breech end of a torpedo tube showing the novel breech door locking and breech door/muzzle door and slide valve mechanical interlock system of the present invention. A breech door 12 having lugs 13 disposed on its outward face in a geometry well known to those skilled in the art is coupled via a mechanical actuator of conventional construction, not shown, to a breech door hinge, not shown, which is mechanically linked to gear 14. The breech door 12 fits within the mouth of the breech end of a torpedo tube 16 in sealing relation with a breech land and seal ring member 17 rotatably mounted therewithin. As will be appreciated by those skilled in the art, the breech land and seal ring member 17 allows replacement of a rubber gasket associated with a slide valve that is part of a torpedo ejection system well known to those skilled in the art.

A breech door locking ring 18 is threaded into an inside circumferential wall of the mouth of the breech end of the torpedo tube 16 and longitudinally outside the breech door 12. The position of the locking ring 18 within the inside circumferential wall of the mouth of the breech end of the torpedo tube has been found to provide reduced bending and other strains compared to the strains that the heretofore known locking ring assemblies have exhibited. The locking ring 18 has lugs in a geometry that matches that of the lugs on the breech door 12, one of which is illustrated at 19 in locking condition against the corresponding lug 13 on the breech door 12.

To open the breech door 12, the locking ring 18 is rotated from its closed condition in the mouth of the breech end of the torpedo tube 16 to its open condition such that each of the lugs thereon are moved into the innerspace between the matching lugs on the breech door 12. With the lugs 13 of the breech door 12 free of the lugs 19 on the locking ring 18, the breech door 12 is moved by a pivoting motion, not shown, out of the mouth of the torpedo tube 16. Concomitantly with the rotation of the breech door, a gear 14, which is mechanically connected to the breech door hinge, actuates a locking ring interlock gag 20 having a rack 21 mechanically engaged with gear 14. The interlock gag 20 is linearly moved through a corresponding aperture, not shown, provided therefor in the locking ring 18, freezing the latter in its open condition.

Figure 2:
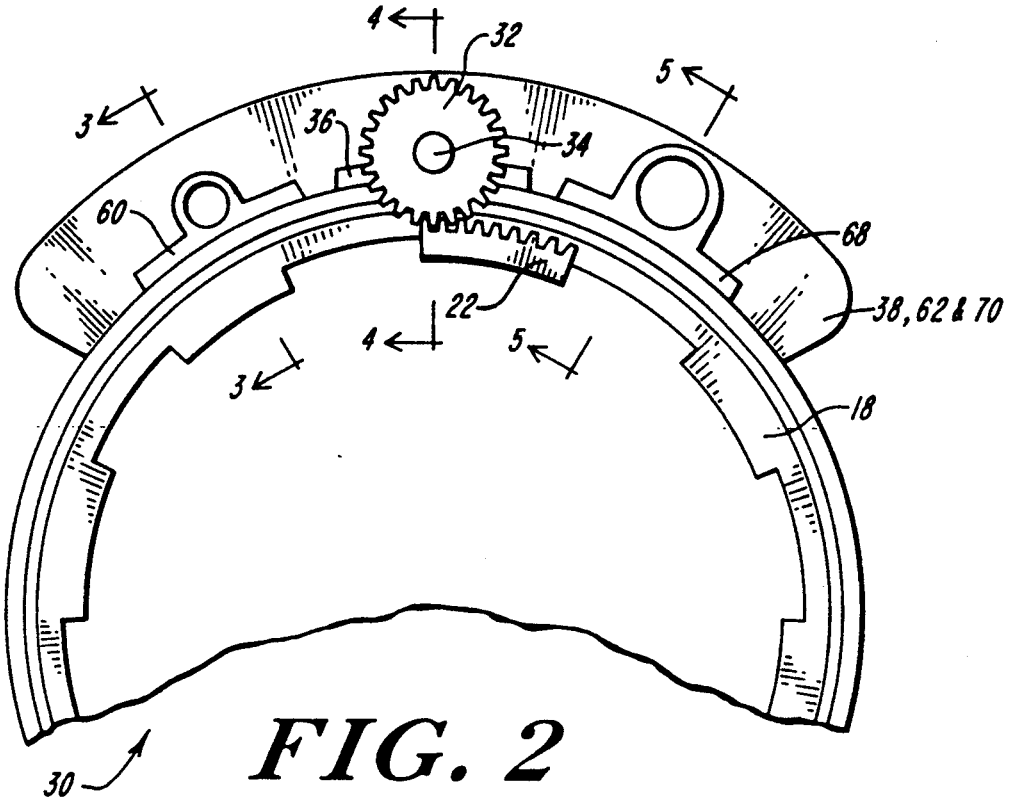
FIG. 2 is an end elevational view of a breech end of a torpedo tube having the breech door locking and breech door/muzzle door and slide valve mechanical interlock system of the present invention.
Figure 4:
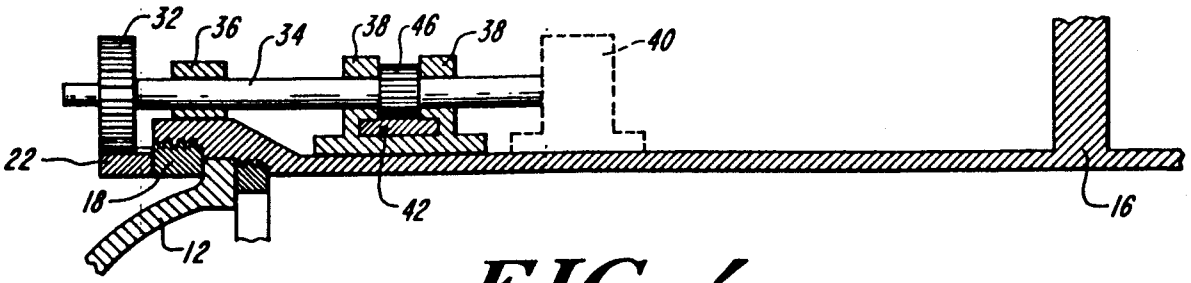

Referring now to FIG. 2, generally designated at 30 is an end elevational view of the breech end of a torpedo tube having the breech door locking and breech door/-muzzle door and slide valve mechanical interlock system of the present invention. The locking ring 18 has a gear segment 22 mounted for rotation therewith that is moved along a circumference as the locking ring is rotated. To the gear 22 a gear 32 is mechanically engaged. As best seen in FIG. 4, the gear 32 is mounted on a shaft 34 that is longitudinally supported in spaced bearings 36, 38 that are, in turn, fastened to the outside surface of the torpedo tube 16. With the rotation of the shaft 34, either manually or by an actuator shown dashed at 40, the gear 32 and therewith the gears 22, 46 are turned.

Figure 6:
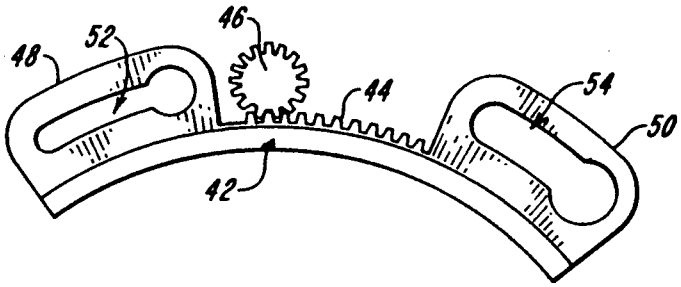
FIG. 6 is a side elevational view of an interlock segment of the breech door looking and breech door/muzzle door and slide valve mechanical interlock system of the present invention.

An interlock segment generally designated 42 as best seen in FIG. 6 is mounted externally of the torpedo tube 16 and entrapped by bearing 38 for rotary motion about the circumference of the tube 16 such that when the interlock segment is in one end condition, the looking ring 18 is in its breech door unlocked condition. When the interlock segment 42 is in any other position, the locking ring 18 is rotated so that the breech door 12 is locked closed. The interlock segment 42 has a rack 44 that is mechanically engaged with a gear 46 mounted for rotation with the shaft 34, such that it is moved between the open and closed condition of the locking ring 18 as the shaft 34 is rotated. With the rotation of the shaft 34, the gear 46 rotates the teeth of rack 44, thereby rotating the interlock segment 42 back and forth about a circumference of the torpedo tube 16 between its breech door locked and unlocked condition. As best seen in FIG. 6, the interlock segment 42 has radially upstanding stops 48, 50 to either side of the gear 44. The flanges 48, 50 are so slotted as to provide elongated openings generally designated 52, 54 that extend along a circumference about the torpedo tube 16 and that exhibit, as shown, comparatively greater and comparatively lesser radial dimensions along their elongation.

Figure 3:
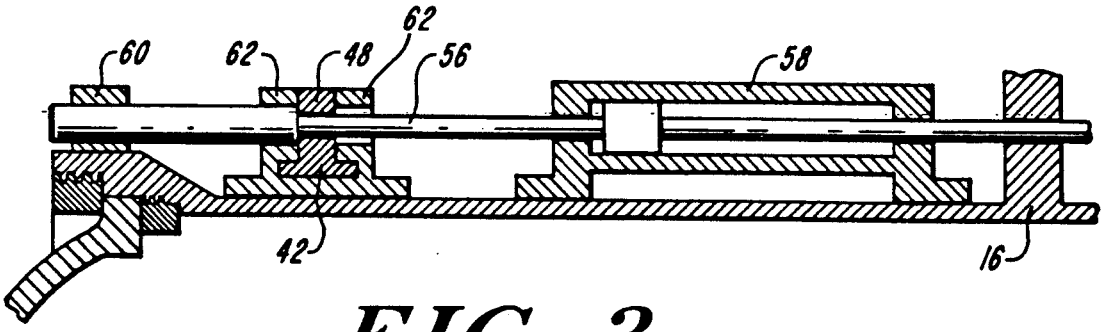
FIGS. 3, 4, and 5 are longitudinal sectional views along the lines 3—3, 4—4, and 5—5 of FIG. 2.

Referring now to FIG. 3, a piston rod 56 of a power cylinder 58 externally mounted to the torpedo tube 16 is slidably mounted in linear bearings 60, 62 fastened in longitudinally spaced apart relation to the outside of the torpedo tube 16. The piston rod 56 extends through the opening 52 of the flange 48 of the interlock segment 42, and is connected to a slide valve, not shown, to the right of the FIG. 3. To open and close the slide valve the rod 56 is reciprocally moved by the actuator 58. The shaft 56 has comparatively greater and comparatively lesser diameter longitudinally spaced shaft portions, as shown, that are commensurate in dimension with the corresponding greater and lesser radial dimensions of the opening 52 of the flange 48 of the interlock segment 42.

Whenever the interlock segment is in its open condition, the comparatively larger dimension portion of the opening 52 of the flange 48 is aligned with the direction of travel of the piston rod 56, permitting the larger dimension longitudinal portion thereof to travel therein-through to actuate the associated slide valve. With the slide valve in its actuated condition, the larger diameter portion of the shaft is in bearing relation to the smaller radial dimension slot portion, which freezes the interlock segment 42 against relative rotation so long as the piston rod 56 extends through the opening 52 in its actuated condition. In the unactuated condition of the slide valve actuator, the comparatively smaller dimension shaft portion extends within the slot 52 of the flange 48, permitting the relative rotation of the shaft and interlock segment.

Figure 5:
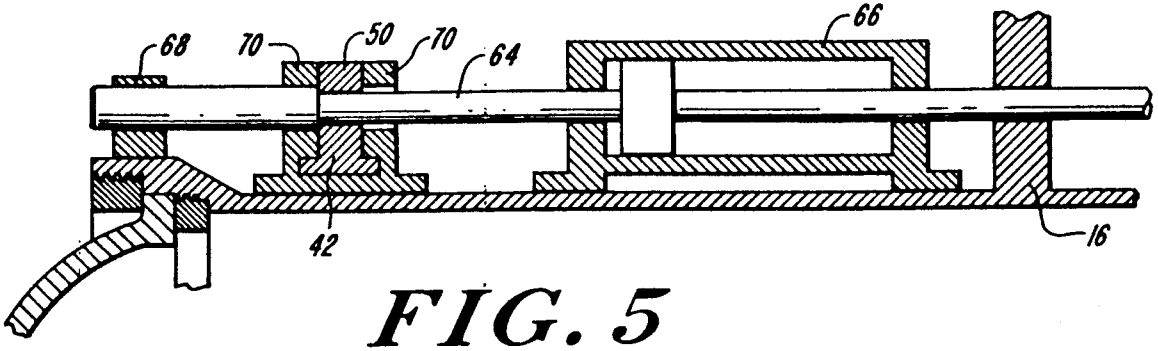

Referring now to FIG. 5, a shaft 64 of a muzzle door actuator power cylinder 66 is mounted on linear bearings 68, 70 with its travel of stroke intercepting and extending through the opening 54 of the flange 50 of the interlock segment 42. The shaft 64 is reciprocally moved to actuate the muzzle door, not shown, to the right of FIG. 5, and has comparatively greater and comparatively smaller dimension longitudinally spaced shaft portions that cooperate with the opening 54 of the flange 50 to freeze the interlock segment 42 and shaft 64 against relative rotation when the muzzle door actuator is in its actuated condition and to permit rotation of the interlock segment when the muzzle door actuator is in its unactuated condition in the same manner as that described above in connection with the description of the slide valve actuator of FIG. 3, and is not separately described again for the sake of brevity of explication.

In operation, and in the nominal state of the mechanical interlock system of the present invention, the interlock segment is in its open condition whenever the locking ring is in its closed condition. To open the breech door at the breech end of the torpedo tube, the shaft 34 is turned, therewith the rack 22 is turned, and the locking ring 18 is thereby turned to its open condition, permitting the opening of the breech door and the rotation of gear 14.

But as the locking ring is rotated, the interlock segment 42 is correspondingly rotated, as the gear 46 is also turned on the shaft 34 against the rack 44 moving the flanges 48, 50 in such a way that the openings of comparatively lesser radial dimension therealong intercept the direction of travel of the comparatively larger dimension shaft portions of the piston rods 56, 64 of the slide valve actuator and muzzle door actuators, thereby preventing their actuation by prohibiting the reception of the associated larger dimension shaft portions through the corresponding lesser dimension flange openings. As the breech door 12 is swung into its open condition, the gear 14 moves the locking ring interlock ga 20 into the opening provided therefor in the locking ring 18, thereby preventing turning of the locking ring 18, freezing the same in its open condition and thereby the muzzle door and slide valve in their closed condition while the breech door is even partially open. With the locking ring in its open condition and frozen, the interlock segment is frozen in its closed condition via the gear train including the elements 22, 32, 34, and 46. Any attempt to rotate the interlock segment to its open condition is therewith prevented, thereby preventing actuation of both the slide valve and muzzle door actuators.

Where either the slide valve or muzzle door actuators are to be actuated, such actuation is only possible with the breech door in its closed condition, and with the locking ring rotated in such position that its lugs abut the corresponding lugs on the breech door. In this case, and only in this case, the larger dimension openings of the flanges 48, 50 are aligned to freely permit the passage of the larger dimension longitudinal shaft portions of the slide valve or muzzle door actuating pistons. When the corresponding actuators 58, 66 are actuated, the piston rods are allowed to freely pass through the aligned enlarged openings, thereby enabling to actuate either the slide valve or muzzle door of the associated torpedo tube. Where either the muzzle door or slide valve is open, the interlock system of the present invention prevents opening, and prevents the attempt to begin opening, the breech door. The breech door, as described above, is only able to be opened whenever the locking ring is able to be rotated in such fashion that its lugs are in the innerspace between the corresponding lugs on the breech door. But when either of the pistons 56, 64 of the slide valve and muzzle door actuators 58, 66 are received through the comparatively larger radial dimension portions of the openings of corresponding flanges 48, 50 of the interlock segment 42, they abut against the constricting walls of the reduced radial dimension portions of the openings 52, 54, thereby freezing the interlock segment in its open condition. Any attempt to rotate the locking ring is therewith effectively prevented over the mechanical linkage including the train of elements 22, 32, 34, 46 and 44.

The instant invention, furthermore, provides a mechanical interlock that reduces the stresses on the locking ring typically encountered in the "Mk 63" system, and achieves a positive reduction in the complexity of the mechanical interlock, with a corresponding reduction in manufacturing costs, service costs, and with a corresponding improvement in operational use and upkeep.

Many modifications of the presently disclosed invention will become apparent to those skilled in the art without departing from the inventive concept.

What is claimed is:

1. A mechanical interlock system for a torpedo tube having a breech end defining a mouth and a muzzle end, a breech door and breech door actuator associated with the mouth of the breech end, a muzzle door and muzzle door actuator associated with the muzzle end, and having a slide valve and associated slide valve actuator, said mechanical interlock system preventing actuation of either the slide valve or muzzle door actuators whenever the breech door is open and has begun to be opened and preventing the opening of the breech door whenever the slide valve and muzzle door are opened and have begun to be opened, comprising:

an interlock member;

means for mounting the interlock member for rotation about a circumference of and external to the torpedo tube between an open condition and a closed condition;

a locking ring;

means for mounting the locking ring to an inside circumferential wall of the mouth of the breech end of the torpedo tube for rotation between an open condition and a closed condition;

means coupled to the interlock member and to the locking ring and cooperative with the interlock member remounting means and with the locking ring mounting means for rotating the locking ring and interlock member together in such a way that the locking ring is in its closed condition when the interlock member is in its open condition, and vice versa;

means cooperative with the interlock member, and with the muzzle door and slide valve actuators, for enabling actuation of the slide valve and muzzle door actuators only if said interlock member is in its open condition;

means cooperative with the interlock member and breech door actuator for enabling actuation of the breech door actuator only if said interlock member is in its closed condition;

means cooperative with said rotating means for freezing said locking ring in its open condition in response to actuating the breech door actuator opening the breech door and therewith freezing the interlock member in its closed condition, thereby preventing actuation of either the slide valve or muzzle door actuators so long as the locking ring is in its open condition or has begun to be opened; and means cooperative with said rotating means and responsive to actuation of either said slide valve or breech door actuators for freezing said interlock member in its open condition, and therewith the locking ring in its closed condition, thereby preventing opening the breech door or the attempt to actuate the breech door actuator so long the interlock member is in its open condition.

2. The invention of claim 1, wherein said locking ring rotation mounting means includes threads provided therefor in the inside circumferential wall of the breech end of the torpedo tube and matching threads on an outside wall of the locking ring.

3. The invention of claim 1, wherein said interlock member and locking ring rotating means includes a rotatable shaft having a first gear mechanically ganged to the interlock segment and a second gear mechanically ganged to the locking ring.

4. The invention of claim 1, wherein said slide valve and muzzle door actuation enabling means includes first and second upstanding flanges having elongated slots that have differential radial dimensions with elongation that are radially upstanding off of said interlock member, and cooperative slide valve and muzzle door actuator shafts that have differential longitudinal dimensions that are commensurate in dimension with said differential radial dimensions of said elongated slots.

5. The invention of claim 4, wherein said interlock member freezing means includes means for causing comparatively larger dimension longitudinally extending shaft portions to abut comparatively smaller dimension radial portions of said slots.

6. The invention of claim 1, wherein said breech door actuation enabling means includes plural lugs depending in a geometry off of said breech door, and plural lugs depending off of said locking ring in a corresponding geometry.

7. The invention of claim 1, wherein said locking ring freezing means includes a locking ring interlock gag that prevents rotation of said locking ring whenever it is in its open condition freezing the same against rotation.

* * * * *